US011808090B2

(12) United States Patent
Zhang et al.

(10) Patent No.: US 11,808,090 B2
(45) Date of Patent: Nov. 7, 2023

(54) FORCE MODULATION SYSTEM FOR A DRILL BIT

(71) Applicants: CNPC USA Corporation, Houston, TX (US); Beijing Huamei Inc. CNPC, Beijing (CN)

(72) Inventors: Ming Zhang, Houston, TX (US); Chris Cheng, Houston, TX (US); Jiaqing Yu, Houston, TX (US); Xiongwen Yang, Beijing (CN)

(73) Assignees: CNPC USA Corporation, Houston, TX (US); Beijing Huamei Inc. CNPC, Beijing (CN)

( * ) Notice: Subject to any disclaimer, the term of this patent is extended or adjusted under 35 U.S.C. 154(b) by 0 days.

(21) Appl. No.: 17/935,126

(22) Filed: Sep. 25, 2022

(65) Prior Publication Data

US 2023/0015607 A1 Jan. 19, 2023

Related U.S. Application Data

(63) Continuation of application No. 17/100,870, filed on Nov. 21, 2020, now Pat. No. 11,499,377.

(51) Int. Cl.

| | |
|---|---|
| ***E21B 10/62*** | (2006.01) |
| ***E21B 10/42*** | (2006.01) |
| ***E21B 12/00*** | (2006.01) |

(52) U.S. Cl.
CPC ..... *E21B 10/62* (2013.01); *E21B 12/00* (2013.01); *E21B 10/42* (2013.01)

(58) Field of Classification Search
CPC ..... E21B 10/62; E21B 12/00; E21B 10/42; E21B 10/00; E21B 10/325; E21B 10/32
See application file for complete search history.

(56) References Cited

U.S. PATENT DOCUMENTS

| | | | | |
|---|---|---|---|---|
| 5,678,645 | A | 10/1997 | Tibbitts et al. | |
| 9,938,814 | B2 | 4/2018 | Hay | |
| 10,494,876 | B2 | 12/2019 | Mayer et al. | |
| 2010/0212964 | A1* | 8/2010 | Beuershausen | E21B 7/064 175/57 |
| 2018/0030786 | A1* | 2/2018 | Dunbar | E21B 10/42 |
| 2019/0249498 | A1* | 8/2019 | Hinz | E21B 10/633 |

FOREIGN PATENT DOCUMENTS

| | | | |
|---|---|---|---|
| CN | 104564064 | A | 4/2015 |
| CN | 204326973 | U | 5/2015 |
| CN | 105604491 | B | 5/2016 |
| CN | 105156035 | B | 3/2017 |
| CN | 108474238 | A | 8/2018 |

* cited by examiner

*Primary Examiner* — Caroline N Butcher
(74) *Attorney, Agent, or Firm* — Craft Chu PLLC; Andrew W. Chu

(57) ABSTRACT

The force modulation system for a drill bit includes a cutter, a holder, a holder retention device, and a first force member. The cutter fits in the holder, and the holder fits in the drill bit. The holder retention device exerts a holder retention force in a first direction. The first force member exerts a first force in a second direction. The second direction is angled offset to the first direction so as that the cutting profile of the force modulation system is now variable in the second direction, according to the first force. There can also be a second force member to exert a second force in the first direction for more variability of the cutting profile in the first direction. The second force member can be made integral with the first force member.

12 Claims, 5 Drawing Sheets

FORCE MODULATION SYSTEM FOR A DRILL BIT

CROSS-REFERENCE TO RELATED APPLICATIONS

The present application claims priority under 35 U.S.C. Section 120 from U.S. patent application Ser. No. 17/100,870, filed on 21 Nov. 2020, entitled "FORCE MODULATION SYSTEM FOR A DRILL BIT". See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to cutting elements on a drill bit. More particularly, the present invention relates to a force modulation system for fixed cutters on the drill bit. Even more particularly, the present invention relates to multi-directional force modulation for fixed cutters on the drill bit.

2. Description of Related Art Including Information Disclosed Under 37 CFR 1.97 and 37 CFR 1.98

Polycrystalline diamond compact (PDC) cutters are used in drilling operations for oil and gas. Prior art drill bits include roller cone bits with multiple parts and rotating cutters to gouge and scrape through the rock formation. Rows of cutters moved along parts of the drill bit so that wear on the cutters was distributed. The multiple parts of the drill bit include the bit blade, bit body, cone, bearing and seal. Newer drill bits were fixed-head drill bits, which were composed of a single drill bit without any moving components. The cutters were fixed on either the bit blade or bit body of the drill bit. The fixed-head drill bits are rotated by the drill string, so moving parts on the drill bit were not needed. The cutters fixed to the parts of the drill bit determine the cutting profile for a drill bit and shear through the rock formation in place on the drill bit. The fixed cutters were more reliable under extreme heat and pressure conditions of the wellbore because there were no moving components. However, the wear on these cutters was substantial.

The further complication is that the wear on fixed cutters is not equal. There are regular sources of damage to all fixed cutters, like vibration and impact load. However, fixed cutters on different parts of the drill bit wear at different rates. For example, the fixed cutters in the cone do not wear at the same rate and manner as fixed cutters on the bit blade. In particular, the fixed cutters placed on the bit blade are on a side of the drill bit and have the highest linear cutting velocity that results in more severe wear and the most cutting force. The damage to all fixed cutters and the extra damage to fixed cutters on the bit blade cause premature failure of the drill bit, limit rate of penetration into the rock formation, and limit the footage drilled into the rock formation.

The prior art already discloses adjustments to the cutting profile of fixed cutters while drilling. FIG. 1 shows the prior art system with a fixed cutter 1 mounted in a holder 2. The holder 2 is mounted in the drill bit 3. There is a retention member 4 to hold the cutter 1 within the holder 2, and there is an elastic member 5 between the holder 2 and the drill bit 3. The elastic member 5 can be a spring, which compresses to lessen the cutting force against harder rock. The lesser force on the fixed cutter can prevent damage. The spring sets the upper limit of cutting force. Any higher load will cause the fixed cutter to retract. Various patents and publication disclose this mechanism of a spring that reduces the force on the fixed cutter, including CN 105604491, published on 2016 May 25 for Li, CN 204326973, published on 2015 May 13 for Ge, Huixiang et al., CN 105156035, published on 2017 Mar. 29 for Hua, Jian et al., USPub 20100212964, published on 2010 Aug. 26 for Beuershausen, U.S. Pat. No. 10,000,977, issued on 2018 Jun. 19 for Jain et al, U.S. Pat. No. 6,142,250, issued on 2000 Nov. 7 for Griffin et al., and U.S. Pat. No. 5,678,645, issued on 1997 Oct. 21 to Tibbitts et al. Being a fixed cutter on refers to being fixed in position on the drill bit. The fixed cutter is not completely locked in position. The fixed cutter is not perfectly fixed in place. The fixed cutter moves toward and away from the drill bit in the one direction of the elastic member.

There have been slight modifications to the prior art system, such as the cutter with retention member directly in the drill bit without a holder. See Zongtao et al., CN 104564064, published on 2015 Apr. 29 for Liu, Zhihai et al. Different elastic members are also known in U.S. patent Ser. No. 10/494,876, issued on 2019 Dec. 3 to Mayer et al., U.S. Pat. No. 9,938,814, issued on 2018 Apr. 10 to Hay, and CN 108474238, published on 2018 Aug. 31 for Grosz, Gregory Christopher. The prior art systems remain unidirectional. The variation in force on the fixed cutter is limited to the orientation of the elastic member. The cutting profile can change only slightly as individual fixed cutters can move up and down in the one direction of the elastic member. The one dimensional variations to the cutting profile fail to effectively protect fixed cutters on the parts of the drill bit that encounter angled forces with drilling. In particular, the fixed cutters on the bit blade or shoulder of the drill bit, known as shoulder cutters, encounter the junctions between different rock formations and require the most cutting force. There are forces against the fixed cutter by the rock formations in more than one dimension at these junctions.

It is an object of the present invention to provide a force modulation system for a drill bit.

It is an object of the present invention to provide a variable cutting profile of a drill bit with fixed cutters.

It is an object of the present invention to provide a force modulation system for fixed cutters on the shoulder of the drill bit.

It is another object of the present invention to provide a multi-directional force modulation system.

It is still another object of the present invention to provide a force modulation system with variable force in a first direction and in a second direction with the second direction being offset or even orthogonal to the first direction.

It is another object of the present invention to provide a cutting profile with fixed cutters variable in two directions relative to the drill bit.

It is another object of the present invention to provide a force modulation system for a drill bit with an elongated holder body.

It is still another object of the present invention to provide a force modulation system for a drill bit with an anchor portion of an elongated holder body between the fixed cutter and force member for the retention member.

These and other objectives and advantages of the present invention will become apparent from a reading of the attached specification, drawings and claims.

BRIEF SUMMARY OF THE INVENTION

Embodiments of the force modulation system for a drill bit include a cutter, a holder, a holder retention means, and a first force member. The cutter is in removable slide fit engagement with the holder. The cutter extends from the holder so as to drill into rock formations. The holder retention means sets the position of the holder within the drill bit. The cutter fits in the holder, and the holder fits in the drill bit. The holder retention means exerts a holder retention force in a first direction of the holder. The holder retention force maintains the position relative to the drill bit. In particular, the first direction is one direction of movement of the holder relative to the drill bit, and the holder retention means exerts the holder retention force in that first direction so as to prevent movement of the holder in that first direction. The first force member is positioned against the holder so as to exert a first force in a second direction of the holder. The first force also maintains the position of the holder relative to the drill bit, but in a different dimension. In particular, the second direction is another direction of movement of the holder relative to the drill bit. The second direction is angled offset to the first direction. The second direction can be orthogonal to the first direction. Relative to the holder cavity, the first direction can be vertical, and the second direction can be horizontal. The holder retention means and the first force member are cooperative to maintain position of the holder in more than one dimension, i.e. in more than the first direction.

The first force in the second direction determines the cutting profile of the force modulation system. The first force member exerts a first force that is variable so that the cutter avoids damage from excessive force in the second direction. The second direction of the first force member is not the same as the first direction. The second direction is offset angled so that excessive force of a different direction than the first direction can be avoided. The force modulation system can avoid damage from excessive force from different directions.

An alternate embodiment of the force modulation system includes a second force member positioned against the holder so as to exert a second force in the first direction of the holder. The second force member is an additional support against excessive force in the first direction. The holder retention member can be set as a breaking point before the critical amount of excessive force that causes damage to the cutter. To protect the holder retention means from being disabled from excessive force, the second force member provides the second force in the first direction as a supplement to the holder retention force in the first direction. The cutting profile of the force modulation is now determined by both the first force in the second direction and the second force in the first direction. The cutter can now avoid the damage of excessive force in the first direction AND in the second direction.

Other embodiments of the present invention include the first force member being made integral with the second force member. There can also be a cutter retention member mounted on the cutter to exert a cutter retention force to hold position of the cutter within the holder. The cutter is removably mounted in the holder, and the cutter can be rotated within the holder so that the cutting surface is additionally adjusted by the rotation of the cutter, in addition to the adjustments between the holder and the drill bit. Some embodiments of the system includes a holder having an initial position relative to the holder retention means and an initial back rake angle and an active drilling position relative to the holder retention means and an active drilling back rake angle. The holder actuates between the initial position and the active drilling position by translation movement or rotational movement. The holder of this embodiment has this additional resistance to excessive force in addition to the first force of the holder retention means and the second force of the first force member.

There can also be embodiments with the holder having an elongated holder body. With an elongated holder body, the holder has an anchor portion that allows the holder to attach to the drill bit without overlapping with the cutter being attached to the holder. The separation of the connectors between the holder and the drill bit and the connectors between the holder and the cutter is more durable. The embodiments of the first force member and the second force member are modified to fit the elongated body. The first force member can still be made integral with the second force member with the first force member being on the longer dimension of the elongated body so as to form a L-shape of the unitary first force member and second force member.

Embodiments of the holder retention means include a screw and through holes in the holder and the drill bit. The screw passes through the holder and embeds into the drill bit to hold position of the holder relative to the drill bit. Embodiments of the holder retention means also include a plurality of side slots in the holder and complementary protrusions, like rails, in the drill bit. There can be a slide fit engagement of the holder to the drill bit.

DETAILED DESCRIPTION OF THE INVENTION

Figure 1:
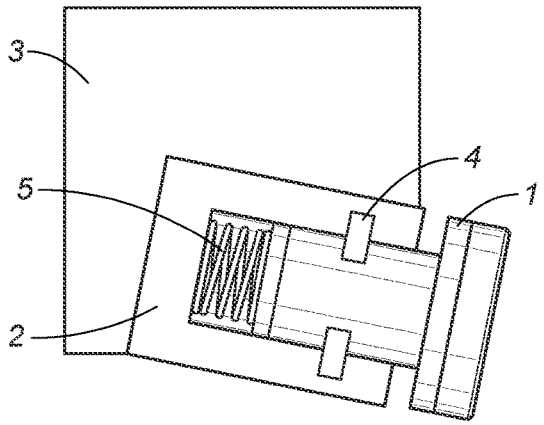
FIG. 1 Prior Art
FIG. 1 is a schematic sectional view of a prior art force modulation system.

Conventional force modulation systems are limited to one dimension and one direction. The cutter, or the cutter in a holder, moves up and down within a drill bit cavity formed to fit the cutter or holder. A spring sits at the bottom of the drill bit cavity. The spring is compressible so as to reduce the amount of force exerted on the cutter by the rock formation. The cutter maintains position within the drill bit cavity to withstand sufficient force to drill through rock, while avoiding excessive force that would damage the cutter. The in and out of the drill bit cavity direction is one dimensional, corresponding to excessive force from depth of cut of the drill bit. These force modulation systems cannot account for offset force vectors, such as those forces created on the shoulder cutters or cutters on the bit blade of the drill bit at junctions between different types of rock materials in a rock formation. There can be excessive force from impact forces of the rock materials that would damage the cutter from a different direction than the one direction set by force modulation systems of the prior art.

Referring to FIGS. 2-14, the force modulation system 10 for a drill bit includes a cutter 20, a holder 30, a holder retention means 50, and a first force member 60. The cutter 20 is comprised of a cutter body 22 having a cutting end 24, and a cutting surface 26 made integral with the cutter body 22 at the cutting end 24. The holder 30 is comprised of a holder body 32 having an anchor end 34, a holding end 36 opposite the anchor end 34, holder sides 38 between the anchor end 34 and the holding end 36, and a holder cavity 40 at the holding end 36. The cutter body 22 is in slide fit engagement with the holder cavity 40. The cutting surface 26 extends from the holder cavity 40 so as to drill into rock formations. The cutter 20 is removably engaged with the holder 30.

Figure 2:
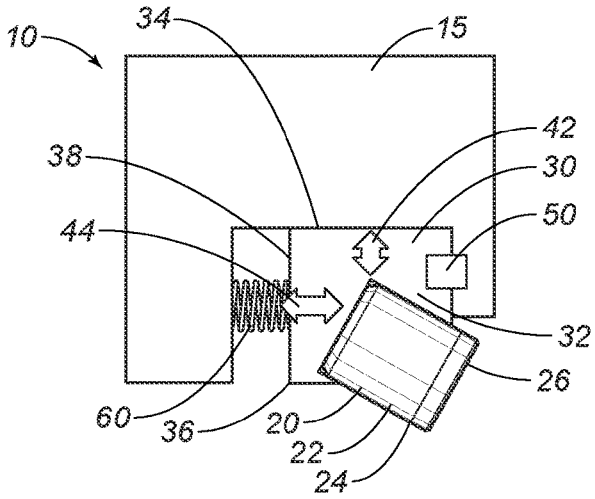
FIG. 2 is a schematic sectional view of an embodiment of the force modulation system according to an embodiment of the present invention.
Figure 3:
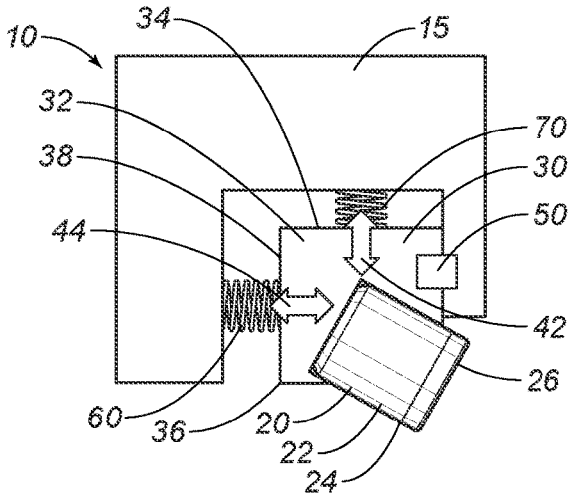
FIG. 3 is a schematic sectional view of an embodiment of the force modulation system according to another embodiment of the present invention.

The force modulation system 10 includes the holder retention means 50 positioned on at least one holder side 38 so as to exert a holder retention force in a first direction 42 of the holder 30. FIGS. 2 and 3 show the first direction 42 as one direction of movement of the holder 30 relative to the drill bit. The holder retention means 50 can be a snap ring as in FIGS. 2-3, shear pin as in FIGS. 2-3, locking ring, locking pin, slot shoulder as in FIGS. 8-10, screw as in FIGS. 12-14 and 16-17 or other known mechanical device to hold position of the holder 30.

Figure 4:
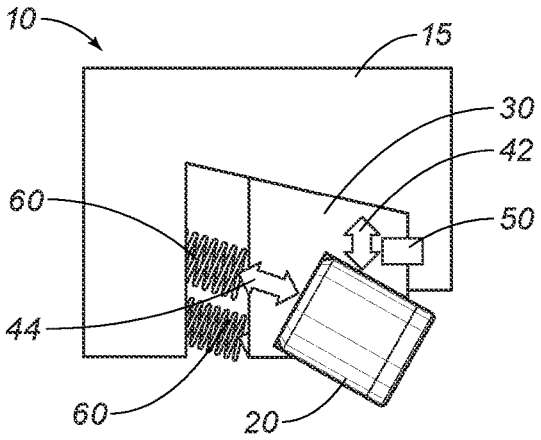
FIG. 4 is a schematic sectional view of an embodiment of the force modulation system according to still another embodiment of the present invention.
Figure 6:
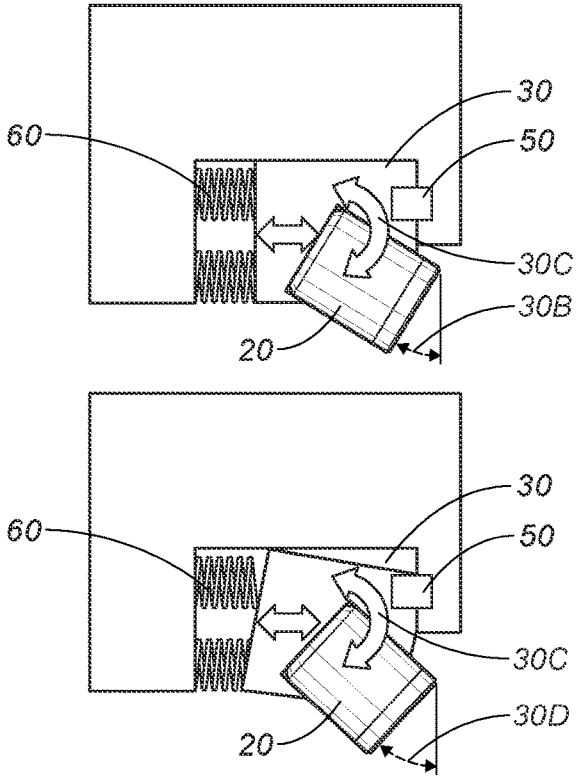
FIG. 6 is a set of schematic sectional views of an embodiment of the force modulation system according to an alternate embodiment of the present invention with the holder in an initial position.
Figure 7:
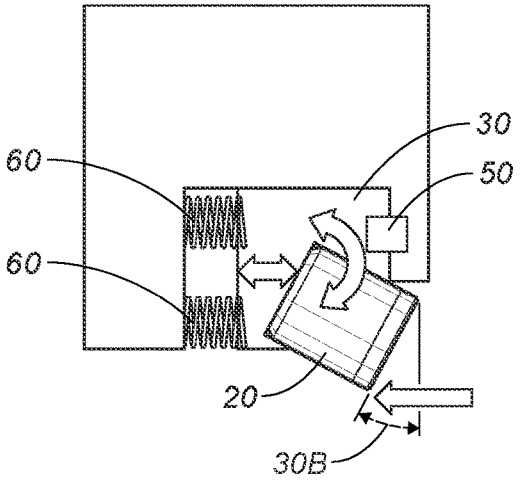
FIG. 7 is a schematic sectional view of an embodiment of the force modulation system according to the embodiment of FIG. 6 with the holder in an active drilling position.

The first force member 60 can be an elastomeric insert, a plastic insert, metal mesh, disc spring, composite elastomeric insert, metal spring, hydraulic actuator, a plurality of each device, or other known mechanical devices to exert force on the holder 30 relative to the drill bit 15. FIGS. 8-14 show the first force member 60 as a rubber insert. FIGS. 2-7 show the first force member 60 as a metal spring, and FIGS. 4, 6, and 7 show embodiments with a plurality of metal springs 60, 60. The first force member 60 is positioned against the holder 30 so as to exert a first force in a second direction 44 of the holder 30. The second direction 44 is angled offset to the first direction 42, as shown in FIGS. 2-7. FIG. 2 shows the first direction 42 of the holder 30 by the holder retention means 50, and the second direction 44 of the holder 30 by the first force member 60. FIG. 2 shows the second direction 44 as orthogonal to the first direction 42. Relative to the holder cavity 40, the first direction 42 can be vertical, and the second direction 44 can be horizontal. FIG. 4 shows another embodiment of the first direction 42 of the holder 30 by the holder retention means 50, and the second direction 44 of the holder 30 by the first force member 60. FIG. 4 shows the second direction 44 as offset to the first direction 42. The angle of offset can range from 60 to 120 degrees. Relative to the holder cavity 40, the first direction 42 can correspond to an in and out of the holder cavity 40 direction, shown as generally vertical. The second direction 44 can be offset from the first direction 42. The angle of offset can range from 60 to 120 degrees. FIG. 4 shows the first force with at least a vector of force in the second direction 44. At least one vector of force in the second direction is shown generally horizontal and not aligned with the first direction.

Alternatively, the first direction 42 can be a direction of movement of the holder 30 relative to the drill bit 15, and the second direction 44 is another direction of movement of the holder 30 relative to the drill bit 15, including orthogonal to first direction 42. FIGS. 2 and 4 show the drill bit 15 and the dimensions of movement of the holder 30 relative to the drill bit 15. The holder retention force in the first direction 42 maintains position relative to the drill bit in the first direction 42. The first force in the second direction 44 determines the cutting profile of the force modulation system 10. The first force member 60 exerts a first force that is variable so that the cutter 20 avoids damage from excessive force in the second direction 44. Unlike the prior art systems, the second direction 44 of the first force member 60 is not the same as the first direction 42. The second direction 44 is offset angled so that excessive force of a different direction than the first direction 42 can be avoided. FIG. 2 shows the second direction 44 orthogonal to the first direction 42. FIG. 4 shows the second direction 44 offset from the first direction 42. The angle of offset can range from 60 to 120 degrees. The first force member 60 in the position as shown is now more than just cumulative with the holder retention means 50 to help resist depth of cut force. There is a new relationship between the first force member 60 and the holder retention means 50. There is new functionality of the force modulation system 10 to avoid damage from excessive force from different angles on the cutter 20.

Figure 5:
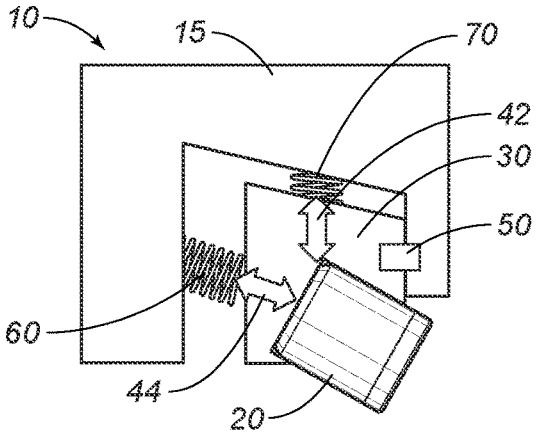
FIG. 5 is a schematic sectional view of an embodiment of the force modulation system according to yet another embodiment of the present invention.

FIGS. 3 and 5 show alternate embodiments of the force modulation system 10 of the present invention with a second force member 70 positioned against the holder 30 so as to exert a second force in the first direction 42 of the holder 30. In this embodiment, the holder retention means 50 can have the holder retention force greater than the second force with both in the first direction 42. The holder retention means 50 can be set as a breaking point before a critical amount of excessive force disables the holder retention means 50. To protect the snap ring from snapping or the screw from fracturing, the second force member 70 provides the second force in the first direction 42 as a supplement to the holder retention force in the first direction 42. The cutting profile is now variable in the first direction 42, according to the second force member 70. The cutter 20 can avoid the damage of excessive force in the first direction 42 AND in the second direction 44 in the embodiment of FIGS. 3 and 5. The second force member 70 can be cumulative and cooperative with the holder retention means 50 to resist depth of cut force. FIG. 3 shows an embodiment with the second force member 70 completely cooperative with the holder retention means 50. The second force member 70 is aligned vertically with the holder retention means 50. FIG. 5 shows an embodiment with the second force member 70 not completely cumulative with the first force member 60 in the second direction 44. The second force in the second direction 44 is still offset from the first direction 42, but the second force only has a vector of force in the first direction 42. The second force member 70 can have a different placement and relationship to the holder 30 and cutter 20. FIG. 3 shows the first direction 42 as generally vertical and the second direction 44 as generally horizontal. FIG. 5 is an embodiment with the first direction 42 remaining generally vertical, while the second direction 44 is offset from the first direction 42 with at least of a vector of the second force in the first direction 42.

In the present invention, there are at least two directions, the first direction 42 and the second direction 44. However, the present invention includes more than a perfect separation of forces into a single direction. The holder retention force, the first force and the second force can be cooperative in the first direction 42 and the second direction 44, as long as there are multiple directions.

Figure 8:
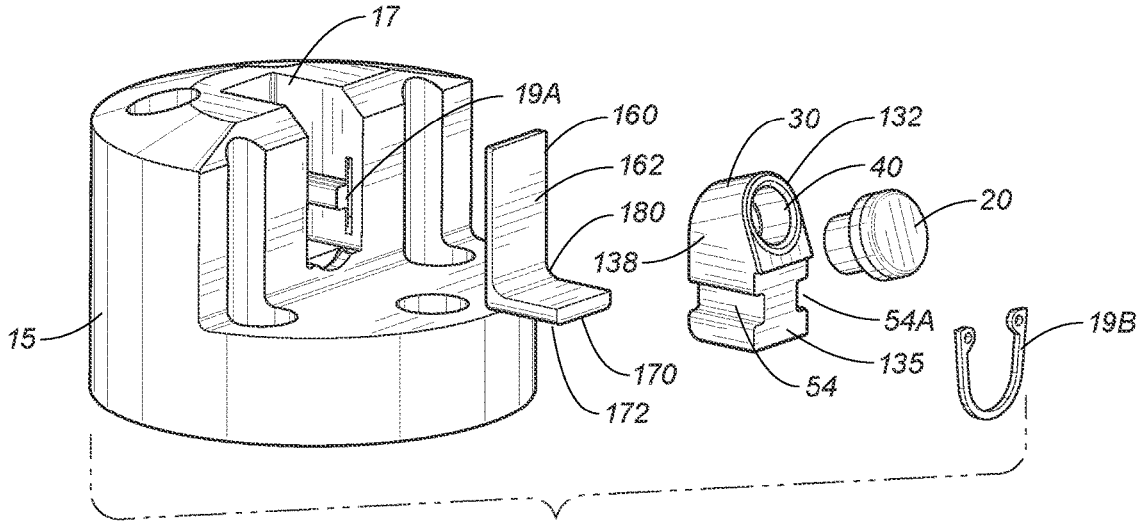
FIG. 8 is an exploded perspective view of an embodiment of the force modulation system with an elongated holder body according to the present invention.
Figure 9:
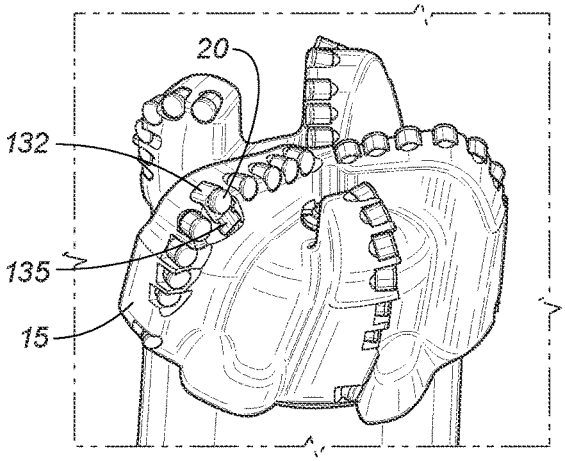
FIG. 9 is a perspective view of the embodiment of the force modulation system of FIG. 6 in a drill bit.
Figure 10:
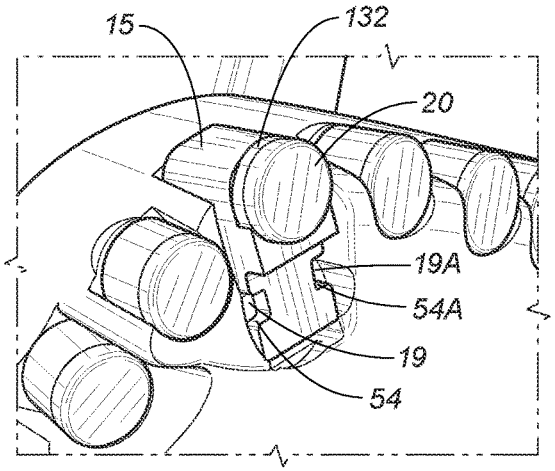
FIG. 10 is an enlarged perspective view of the embodiment of the force modulation system of FIG. 8 and FIG. 9 in a drill bit.
Figure 13:
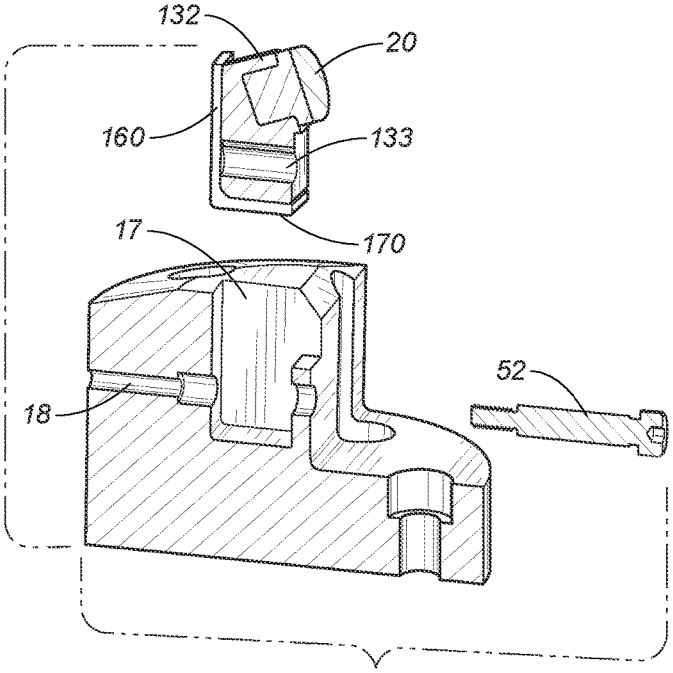
FIG. 13 is an exploded perspective view of the embodiment of the force modulation system of FIG. 12.
Figure 14:
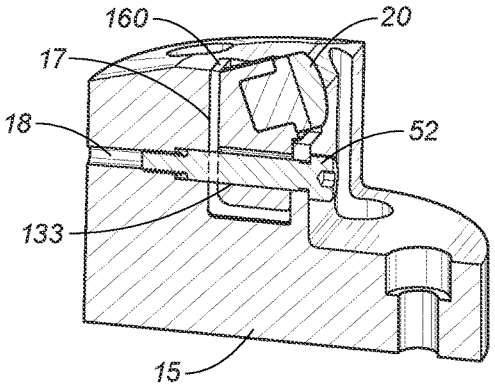
FIG. 14 is a schematic sectional view of the embodiment of the force modulation system of FIGS. 12-13.

FIGS. 8, 13, and 14 show embodiments of the first force member 160 as being made integral with the second force member 170. Whether an elastomeric insert, a plastic insert, metal mesh, composite elastomeric insert, or other known mechanical device to exert force on the holder 30 relative to the drill bit 15, the first force member 160 can be made integral with the second force member 170. As an elastomeric or rubber insert, there can be a first spring portion 162 and a second spring portion 172 with a hinge portion 180 between the first spring portion 162 and the second spring portion 172. The offset angled relationship as orthogonal for the first direction 42 and second direction 44 are also shown in FIGS. 8, 13, and 14, even with the first force member 160 and the second force member 170 being unitary.

Embodiments of the force modulation system 10 of the present invention include a cutter retention member 80 mounted on the cutter body 22 as prior art cutter retention member 4 in FIG. 1. The cutter retention member 80 of FIG. 11 exerts a cutter retention force to hold position of the cutter 20 within the holder cavity 40. Similar to the holder retention member 50, the cutter retention member can be a snap ring, shear pins as in FIG. 11, locking ring, locking pin, slot, screw or other known mechanical device to hold position of the cutter 20. The cutter retention force can be greater than holder retention force so that the cutter 20 remains anchored to the holder 30, regardless of the force exerted on the holder 30 relative to the drill bit 15. The cutter 20 holds tight to the holder 30.

The cutter 20 is removably mounted in the holder 30. The cutter 20 can be rotated within the holder 30 so that the cutting surface 26 is adjusted relative to the holder cavity 40. In addition to the adjustments between the holder 30 and the drill bit 15, the cutter 20 is rotatable for wear on the cutting surface 26 to be changed. FIGS. 6-7 show embodiments of the system including a holder 30 having an initial position 30A relative to the holder retention means 50 and an initial back rake angle 30B and an active drilling position 30C relative to the holder retention means 50 and an active drilling back rake angle 30D. The holder 30 actuates between the initial position and the active drilling position by translation movement in FIG. 7 or rotational movement in FIG. 6. The holder 30 of this embodiment has this additional resistance to excessive force in addition to the first force of the holder retention means 50 in the first direction 42 and the second force of the first force member 70 in the second direction 44.

There can be at least one degree of freedom to allow cutter 30 rotation in the plane determined by the first direction 42 and the second direction 44. Back rake angle is a key factor in defining the aggressiveness or depth of cut by a cutter 30. Back rake angle is preset and fixed on conventional drill bit. In FIG. 6, there is a preset back rake angle or initial back rake angle 30B defined by the relation between holder 30, holder retention means 50 and the first force member 60. Depending on the first force of the first force member 60, the holder 30 can rotate relative to the holder retention member 50. The initial back rake angle 30B is smaller than the active drilling back rake angle 30D in FIG. 6. During drilling, back rake angle increases and changes aggressiveness when the cutting force applied on the lower portion of cutter 20 is sufficiently large. The excessive force can actuate the holder 30 from the initial position 30A to the active drilling position 30C by rotation. The holder retention means 50 is reset and still exerts a first force in the first direction 42 to set the force modulation profile of the cutter 20. Excessive force can be resisted by this embodiment of the holder 30 with both the initial position 30A and the active drilling position 30C. FIG. 7 is another embodiment of holder 30 with both the initial position 30A and the active drilling position 30C. Translational movement of the holder 30 alters the initial back rake angle 30B and the active drilling back rake angle 30D in FIG. 7. The embodiment of the holder 30 can have significant influence on cutting force and efficiency.

Alternate embodiments of the force modulation system 10 include the holder 30 in FIGS. 8-14 with the holder sides longer than the anchor end 34 and the holding end 36 so as to form an elongated holder body 132 having an anchor end 34, a holding end 36 opposite the anchor end and elongated holder sides 138. FIGS. 8-14 show the elongated holder body 132 having an anchor portion 135 between the holder cavity 40 and the anchor end 34. The first direction 42 is now aligned along the elongated holder sides 138.

The embodiment with the elongated holder body 132 can further include a second force member 70 positioned against the anchor end 34 of the holder 30 so as to exert the second force in the first direction 42 of the holder 30. The holder retention force remains greater than the second force in this alternate embodiment. The second force is variable so that excessive force in the first direction 42 is less likely to break and disable the holder retention means 50. The cutting profile is now variable in more than one direction and avoids excessive force in more than one direction.

FIGS. 8-14 show the first force member 160 being made integral with the second force member 170. There is a first rubber spring portion 162 as the first force member 160 and a second rubber spring portion 172 as the second force member 170 with a hinge portion 180 between the first rubber spring portion 162 and the second rubber spring portion 172. The hinge portion 180 sets the first rubber spring portion 162 for the first force in the second direction 44 and the second rubber spring portion 172 for the second force in the first direction 42.

Figure 11:
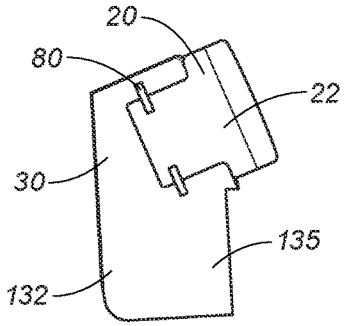
FIG. 11 is a schematic sectional view of an embodiment of the elongated holder body of FIGS. 8-10.
Figure 12:
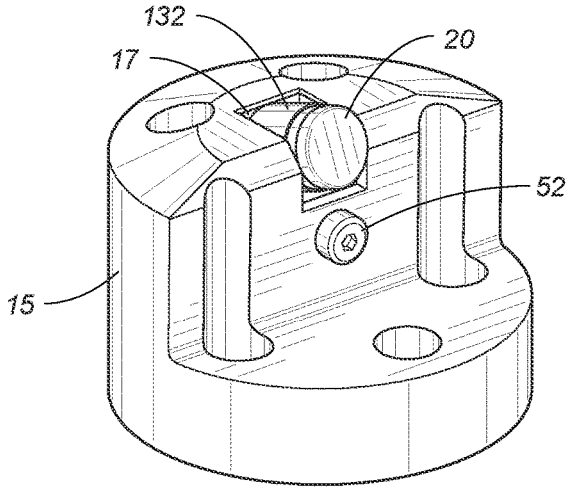
FIG. 12 is a perspective view of another embodiment of the force modulation system with another elongated holder body, according to the present invention.

An embodiment of the holder retention means 50 is comprised of a screw 52 as shown in FIGS. 11-14. For the screw 52, there is a holder housing 17 of the drill bit 15 being comprised of a threaded hole 18, and the elongated holder body 132 has a through hole 133. The screw 52 is in removable threaded engagement with the threaded hole 18 through the through hole 133 of elongated holder body 132. The assembled view is shown in FIG. 12 with the screw 52 visible on the drill bit 15. The exploded view of FIG. 13 and the sectional view of FIG. 14 show the screw 52 before assembly through the drill bit 15 and the elongated holder body 132. The drill bit 15 can fit the screw 52 around the first force member 160 being made integral with the second force member 170. The first force member 160 being made integral with the second force member 170 may also have a hole for the screw 52 to pass through the first force member 160 being made integral with the second force member 170.

Another embodiment of the holder retention means 50 is comprised of a plurality of slots 54, 54A on the elongated body 132 as shown in FIGS. 8-11. FIG. 11 is consistent with both embodiments of the holder retention means 50. FIG. 8 shows the exploded view of the slots 54, 54A so as to be friction fit in the drill bit 15. There is a holder housing 17 with a protrusion 19, 19A. The slot 54 is in removable sliding engagement with the protrusion 19 so as to exert the holder retention force in the first direction 42. In some embodiments, there is another slot 54A on another side of the elongated body 132 in removable sliding engagement with another protrusion 19A of the holder housing 17. Embodiments of the protrusions 19, 19A are shown as rails in FIGS. 8-10. There is a locking shoulder engagement between the slots 54, 54A and the protrusions 19, 19A as rails. There is a slot retention member 19B to friction fit between the holder 30 and the holder housing 17.

Figure 15:
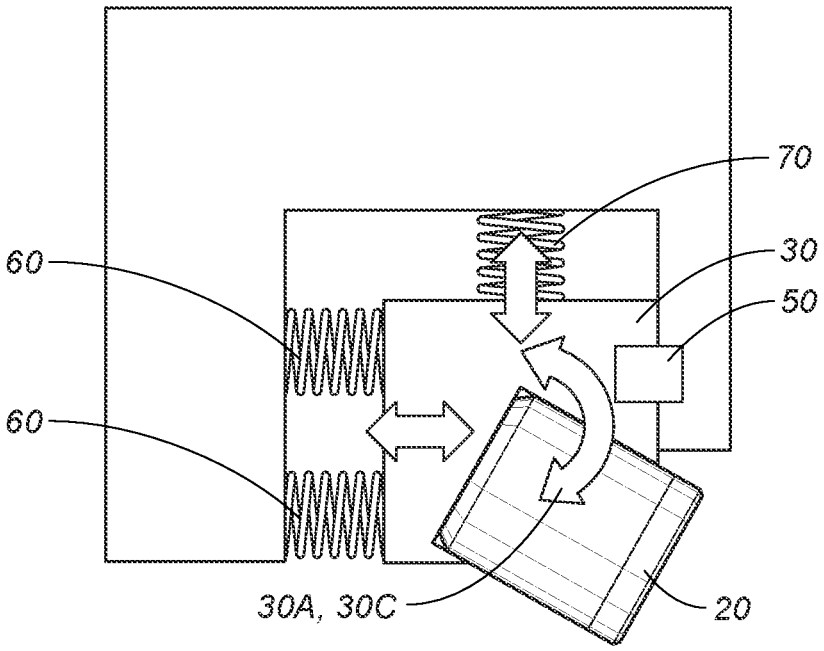
FIG. 15 is a schematic sectional view of the alternate embodiment of the force modulation system according to FIGS. 6 and 7 with a second force member.
Figure 16:
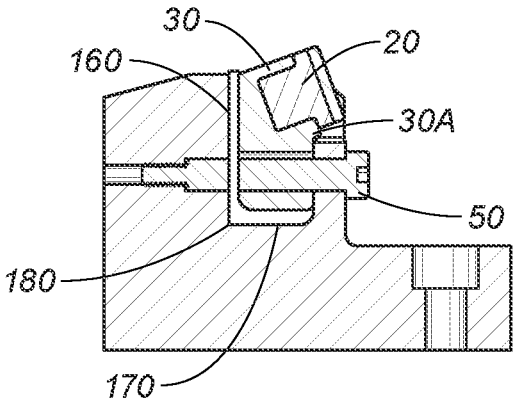
FIG. 16 is a schematic sectional view of the alternate embodiment of FIG. 15 with an elongated holder body.
Figure 17:
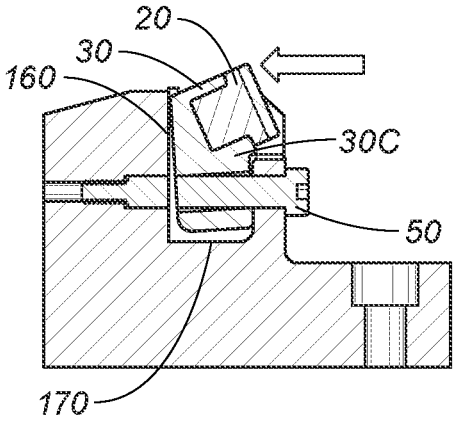
FIG. 17 is a schematic sectional view of the alternate embodiment of FIG. 15 with an elongated holder body.

FIGS. 15-17 show alternative embodiments of the system, according to FIGS. 6-7 for an elongated holder body 132 of FIGS. 8-14. FIG. 15 shows a version of FIG. 6 with a second force member 70 and plurality of metal springs 60, 60 as the first force member 60. The second force member 70 allows another degree of rotation in cooperation with the holder retention means 50. Just as the second force member 70 supports the holder retention means 50 with a second force in the first direction 42, the second force member 70 can support rotation of the holder 30 relative to the holder retention means 50. Additionally, the plurality of metal springs 60, 60 further supports rotation of the holder 30 relative to the holder retention means 50. With an elongated holder body 132, the holder 30 can also rotate by the first force member 60. FIGS. 16-17 show the holder 30 having an initial position 30A relative to the holder retention means 50 and an initial back rake angle 30B and an active drilling position 30C relative to the holder retention means 50 and an active drilling back rake angle 30D. The holder 30 actuates between the initial position and the active drilling position by rotational movement in FIGS. 16-17. The holder 30 of this alternative embodiment shows a gap between the holder 30 and the holder retention means 50 to allow the rotation. The holder 30 of these embodiments also have this additional resistance to excessive force in addition to the first force of the holder retention means 50 in the first direction 42 and the second force of the first force member 70 in the second direction 44.

The present invention is a force modulation system for a drill bit. The system forms a variable cutting profile as the fixed cutters can have different contact on a rock formation while drilling. The cutting profile changes to avoid excessive force that would damage the fixed cutters. The force modulation system has particular usefulness for fixed cutters on the blade of the bit body or shoulder of the drill bit. These cutters on the blade of the bit body or shoulder of the drill bit typically drill the rock formation at junctions between different types of rock materials. There is a higher risk of excessive force to damage cutters at these joints. The force modulation of the system can avoid this excessive force.

The present invention is a multi-directional force modulation system. Instead of being restricted to the one direction of in and out of the drill bit cavity, corresponding only to depth of cut, the system can also move cutters in another direction side to side within the drill bit cavity. The cutting profile is variable in more than one dimension. In some embodiments, the first direction is set by a holder retention member relative to the drill bit, and the second direction is set by the first force member offset from the holder retention member. In other embodiments, there is a second force member that is set in the first direction to back up the holder retention member.

The first direction and the second direction are angled offset from each other. The first and second directions can be orthogonal to each other. The holder retention force can be in the first direction, and the first force can be in the second direction. In alternate embodiments, forces are not completely aligned in a single direction. The first force is not in the first direction or the second direction. At least a vector of the first force must be in the second direction, not all of the first force. For other variable cutting profiles, there is no avoidance of excessive forces from more than one direction. Additionally, the cutter is rotatable so that the cutting surface extending from the holder cavity can affect the resistance to excessive forces. The variable cutting profiles of the prior art only compensate for a particular excessive force to avoid damage, instead of the different excessive forces from different directions. In the prior art systems, the one direction must be selected according to placement of the fixed cutter on the part of the drill bit. The multi-directional force modulation system can now avoid excessive force from more than one direction. The drill bit has an extended working life by avoid more excessive force on cutters than other prior art systems.

In addition to variable cutting profiles, the system includes a holder actuatable between an initial back rake angle and an active drilling back rake angle. The holder actuates between the initial position and the active drilling position by translation movement or rotational movement or both. The holder of this embodiment has this additional resistance to excessive force by an adjustable back rake angle in addition to the first force of the holder retention means in the first direction and the second force of the first force member in the second direction.

The force modulation system can also have an elongated holder body. The elongated holder body has an anchor portion that allows the holder to attach to the drill bit without overlapping with the cutter being attached to the holder. The separation of the connectors between the holder and the drill bit and the connectors between the holder and the cutter maintains the same relationships between the holder retention means in the first direction and the first force member in the second direction. This arrangement is more durable. The wear of the connection between the holder and the drill bit is now separate from any wear of the holder and the cutter. A cutter can be replaced in the holder, if the holder remains in good condition and can still be engaged with the drill bit.

The foregoing disclosure and description of the invention is illustrative and explanatory thereof. Various changes in the details of the illustrated structures, construction and method can be made without departing from the true spirit of the invention.

We claim:

1. A force modulation system for a drill bit, comprising:

a cutter being comprised of a cutter body having a cutting end, and a cutting surface made integral with said cutter body at said cutting end;

a holder being comprised of a holder body having an anchor end, a holding end opposite said anchor end, holder sides between said anchor end and said holding end, and a holder cavity at said holding end, said cutter body being in removable slide fit engagement with said holder cavity;

a holder retention means positioned on at least one holder side so as to exert a holder retention force in a first direction of said holder;

a first force member positioned against said holder so as to exert a first force in a second direction of said holder, said second direction being angled offset to said first direction; and a second force member positioned against said holder so as to exert a second force in said first direction of said holder, wherein said first direction is a direction of movement of said holder and said cutter relative to the drill bit, and wherein said second direction is another direction of movement of said holder and said cutter relative to the drill bit, wherein said second direction is offset from said first direction so as to avoid damage from excessive force on said cutter in directions other than said first direction, wherein first force member is made integral with said second force member, and wherein said first force member being made integral with said second force member is comprised of a first spring portion, a second spring portion, and a hinge portion between said first spring portion and said second spring portion, said second force member being comprised of said second spring portion.

2. The force modulation system, according to claim 1, said cutter being removably engaged with said holder, said cutting surface being extended from said holder so as to cut a rock formation.

3. The force modulation system, according to claim 1, wherein said holder has an initial position relative to said holder retention means and an initial back rake angle, and wherein said holder has an active drilling position relative to said holder retention means and an active drilling back rake angle, said holder being actuatable between said initial position and said active drilling position.

4. The force modulation system, according to claim 3, wherein said holder is actuatable between initial position and said active drilling position by one of a group consisting of: translational movement of said holder relative to said holder retention means and rotational movement of said holder relative to said holder retention means.

5. The force modulation system, according to claim 1, wherein said second direction is orthogonal to said first direction.

6. The force modulation system, according to claim 1, wherein said holder retention force is greater than said second force.

7. The force modulation system, according to claim 1, wherein said cutter retention force greater than holder retention force.

8. The force modulation system, according to claim 1, wherein said holder sides are longer than said anchor end and said holding end so as to form an elongated holder body having said anchor end, said holding end opposite said anchor end and elongated holder sides as said holding sides.

9. The force modulation system, according to claim 8, wherein said elongated holder body is comprised of an anchor portion between said holder cavity and said anchor end, said first direction being along said elongated holder sides.

10. The force modulation system, according to claim 9, wherein said second force member is positioned against said anchor end of said holder so as to exert said second force in said first direction of said holder.

11. The force modulation system, according to claim 10, wherein said holder retention force is greater than said second force.

12. The force modulation system, according to claim 10, wherein first force member is made integral with said second force member.

* * * * *